United States Patent [19]

Manix

[11] Patent Number: 4,943,252

[45] Date of Patent: Jul. 24, 1990

[54] AVALANCHE FLOTATION BALL

[76] Inventor: Thomas J. Manix, 4021 Marquis Way, Anchorage, Ak. 99502

[21] Appl. No.: 204,271

[22] Filed: Jun. 9, 1988

[51] Int. Cl.[5] ..... B63C 9/06

[52] U.S. Cl. ..... 441/87

[58] Field of Search ..... 441/86, 87, 38, 40–42; 114/349, 346; 280/206; 272/1 B

[56] References Cited

U.S. PATENT DOCUMENTS

| | | | |
|---|---|---|---|
| 616,439 | 12/1898 | Shepherd | 441/87 X |
| 659,807 | 10/1900 | Barton | 441/87 |
| 1,042,327 | 10/1912 | Costanzo | 441/87 |
| 2,367,835 | 1/1945 | Kreyer | 441/40 |
| 2,399,670 | 5/1946 | Freygang | 441/41 |
| 3,066,951 | 12/1962 | Gray | 280/206 |
| 3,768,467 | 10/1973 | Jennings | 441/38 X |
| 3,883,913 | 5/1975 | Givens | 441/38 X |

*Primary Examiner*—Sherman D. Basinger

[57] ABSTRACT

A quickly inflatable survival device for skiers comprising a protective and bouyant plurality of concentric spheres made of flexibly impervious material which is stored uninflated around the waist in a belt pack (64), using a detachably attached belt (28), and covered with a detachable flexible cover (52). To activate when needed, an inflation pull ring (62) connected to a pressure vessel and valve (30) is manually pulled to release a pressurized gas into the chambers (20) between the inner sphere wall (40) and the outer sphere wall (38), the sphere walls being limited in separation by the use of wall partition segments (44,46,48) having air communications openings (42) to allow free air flow throughout the chambers (20). Immediately after pulling the inflation ring (62), the person crouches down and the sphere is very quickly and forcefully expanded, detaching the cover (52), to its inflated spherical configuration and totally encloses the person, providing protection and buoyancy in snow avalanche environments. Deflation is accomplished using the pressure relief valve (26), then either exit enclosure (24/36) is opened using the fabric handles (22) and the occupant releases the belt (28) and steps out of the device.

4 Claims, 8 Drawing Sheets

FIG. 1
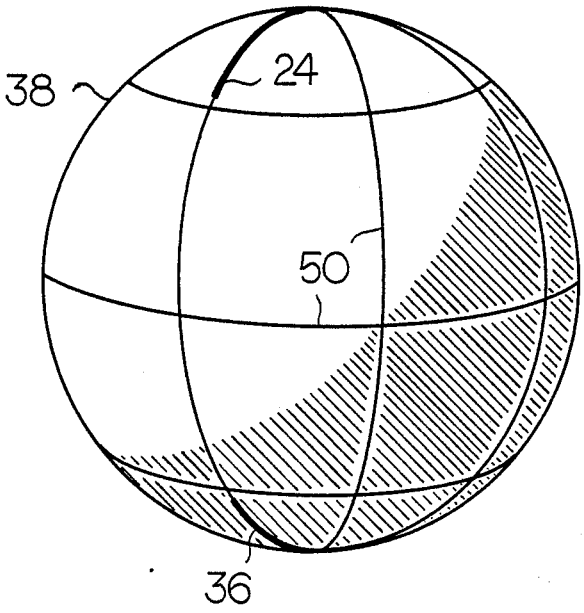
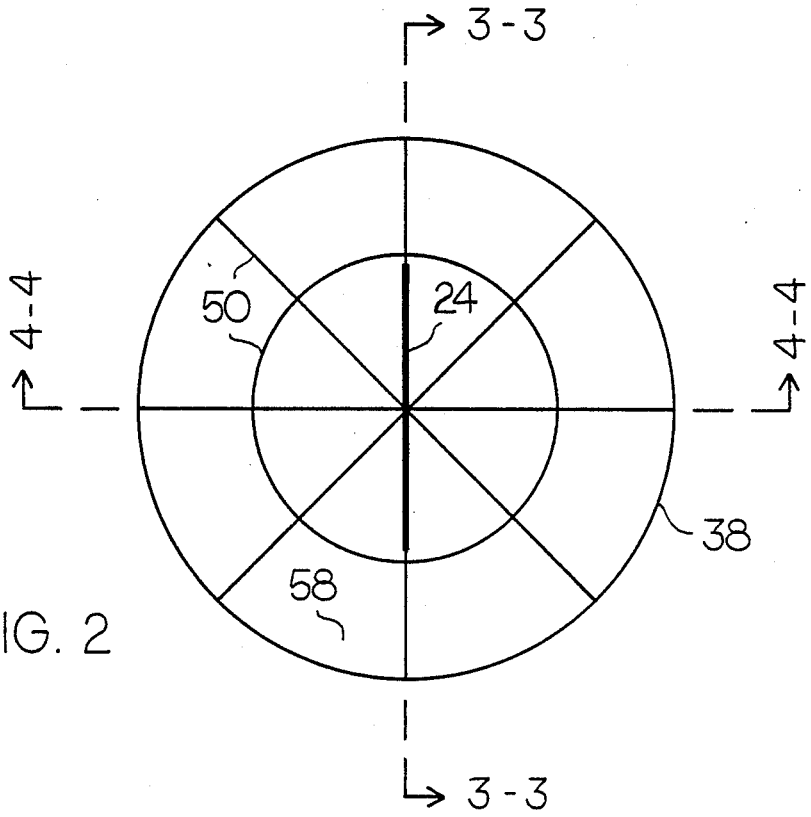
FIG. 2

AVALANCHE FLOTATION BALL

BACKGROUND

1. Field of Invention

The present invention relates to survival equipment and, in particular, to life preserver equipment that protects, provides buoyancy, and preserves a skier's life in snow avalanches.

2. Discussion of Prior Art

Heretofore, the survival of a person caught in an avalanche depended, in part, on one's ability to use a swimming motion to try to stay on top of the snow slide until it stopped moving. This technique can be combined with the use of a small electronic device which incorporates a transmitter and receiver worn on one's clothing. Survival of the avalanche victim then depended on other trained people in the group that are wearing these devices to locate the buried victim and dig the person from underneath the snow before suffocation and death occurred. These rescue persons remain in danger of burial from a second avalanche.

The Avalanche Survival Vest in Patent No. 4,365,628 approached the problem of avalanche survival by providing a way to continue breathing for a while after one was buried in the snow, unless the weight of the snow would not allow for the expansion of the lungs.

The present invention will protect the person from becoming submerged in the snow by quickly and totally enclosing one's body in a large pressurized protective sphere and allowing one to float and bounce on top of a snow slide, rather than allowing the snow to surround a person's extremities and drag the body underneath the sliding snow. The protective device is constructed with two or more concentric spheres formed with a pliable and imprevious material forming spaced chambers whereby the same can be inflated.

OBJECTS AND ADVANTAGES

Accordingly, several objects and advantages of my invention are as follows:

1. allows safer back-country skiing and ski resort avalanche patrolling by preventing submersion in snow avalanches;
2. provides protection of the body from objects associated with avalanches;
3. provides lightweight, personal, transportable and immediately inflatable protection;
4. provides a source of breathable air, if needed;
5. quick and easy to put on and to operate; reusable;
6. will work in both snow and marine environments.

The disadvantages of the prior art are that they do not provide buoyancy, protect, or prevent a person from getting buried in a snow slide. Further objects and advantages will become apparent from consideration of the drawings and the ensuing descriptions of them.

DESCRIPTION OF DRAWING FIGURES

FIG. 1 shows a perspective view of the inflated present invention with the exit enclosures at the top and bottom.

FIG. 2 is a perspective view showing the inflated present invention and the top/bottom typical exit enclosures.

Figure 3:
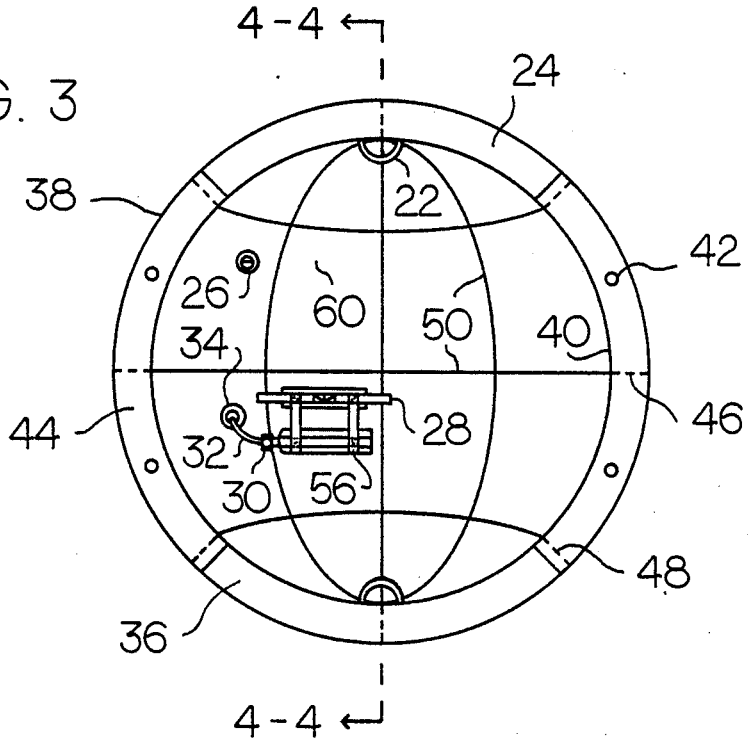
FIG. 3 shows a section view of the inflated present invention along section line 3—3 of FIG. 2 showing the belt, pressure vessel, bulkhead fitting, pressure relief valve and the exist enclosures.

FIGS. 13 A–D show the typical wall partition segments for the large latitudinal wall partitions, small latitudinal wall partitions and the longitudinal wall partitions and a detail of the exist enclosure.

List of Reference Numerals

20 chamber
22 fabric handles
24 top exit enclosure
26 pressure relief valve
28 belt, detachably attached
30 pressure vessel and valve
32 hose, high pressure flexible
34 bulkhead fitting
36 bottom exit enclosure
38 outer sphere wall
40 inner sphere wall
42 typical air communication openings in wall partition material
44 longitudinal wall partition segment
46 large latitudinal wall partition segment
48 small latitudinal wall partition segment
50 material seam, typical
52 detachable cover for belt pack
54 belt buckle
56 bottle straps attached to belt
58 outer sphere wall panel segment
60 inner sphere wall panel segment
62 inflation pull ring
64 belt pack
66 hook and loop fasteners

DESCRIPTION OF INVENTION

The present invention is a life-preserving, buoyant and protective device that is constructed of two or more concentric spheres using flexibly impervious material including inner and outer sphere walls defining an inflatable and airtight space therebetween.

The said space can be inflated with a gas substantially in excess of ambient pressure in the said space between the sphere walls, partitioning means in said space limiting the separation of the inner and outer sphere walls, whereby the present invention is expanded quickly and forcefully to its generally spherical configuration and strongly tends to retain and regain such configuration against any deforming forces. This provides a protective cushioning effect and buoyancy for the occupant. The person should assume the fetal position after manually pulling the inflation pull ring to allow the body to be totally enclosed by the present invention that very quickly inflates with the introduction of a pressurized gas into the chambers inside said space. The materials for the present invention are selected for superior performance in their intended functions in their anticipated enviroment of use. Pre-eminent among such characteristics are strength, flexibility and durability, especially at lower temperatures, and resistance to air and water porosity.

Referring now to the drawings wherein like numerals designate like parts throughout the various views, the FIGS. 1 and 2 show views of the present invention in an inflated condition.

FIG. 1 is a perspective view showing the outer sphere wall 38 covering the present invention and the location of the top exit enclosure 24 and bottom exit enclosure 36 along with the typical material seams 50.

FIG. 2 is a top view allowing a better view of the top exit enclosure 24 and showing the material seams 50 converging at the top of the present invention.

FIG. 3 is a section view along the section line 3—3 in FIG. 2 showing one half of the inflated present invention. In particular FIG. 3 shows the top exit enclosure 24 and the bottom exit enclosure 36 and the fabric handles 22 used to separate the two sides of the exit enclosure panels 24,36 upon deflation. The exit enclosures 24,36 are covered with the well known Dupont brand velcro hook and loop fastener material. The pressure relief valve 26, the detachably attached belt 28, the pressure vessel and valve 30, the high pressure hose 32 and bulkhead fitting 34 are also shown. FIG. 3 also shows the outer sphere wall 38, the inner sphere wall 40, the air communication openings 42 in the typical longitudinal wall partition segments 44, and the typical material seams 50 located on the inner sphere wall 40.

Figure 4:
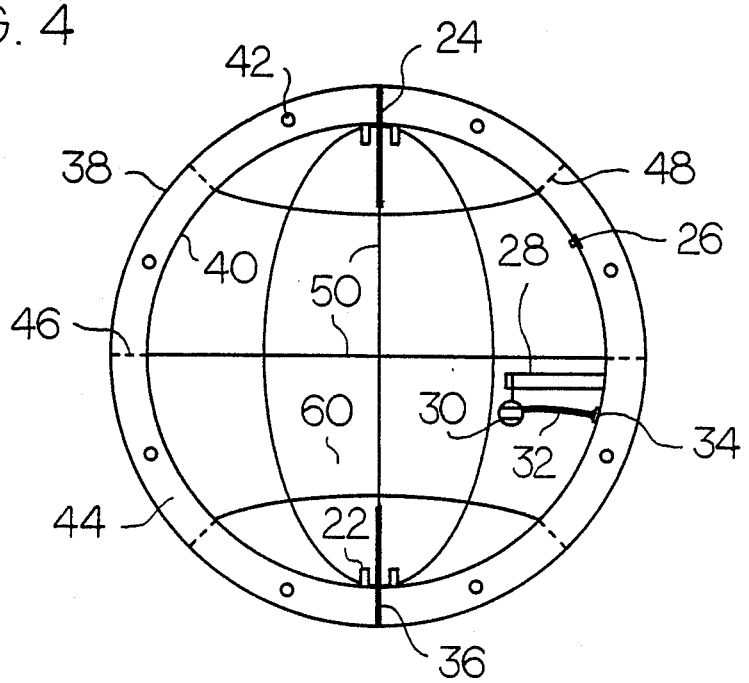
FIG. 4 is a section view along the section line 4—4 of FIG. 2 showing the belt area with the detachably attached belt, pressure vessel and valve, hose, bulkhead fitting and pressure relief valve.

FIG. 4 is a section view of the inflated present invention along the section line 4–4 of FIG. 2 showing the belt 28 secured to the inner sphere wall 40 at the back of the belt 28. The pressure vessel and valve 30 are secured to the front of the detachably attached belt 28 by means of the bottle straps 56 and the high pressure hose 32 is connected to the pressure vessel and valve 30 and also to the bulkhead fitting 34 at the inner sphere wall 40. The arrangement of the bulkhead fitting being such that the inner sphere wall 40 is sealingly gripped between the parts of the bulkhead fitting 34. The pressure relief valve 26 is located on the inner sphere wall 40. The outer sphere wall 38 is held in place with the typical longitudinal wall partition segments 44 and the typical large latitudinal wall partition segments 46 and the typical small latitudinal wall partition segments 48. The edges of the wall partition segments are sealingly and flexibly attached to both the inner sphere wall 40 and the outer sphere wall 38. The air communication openings 42 are typically placed in each wall partition segment 44,46,48. The top exit enclosure 24 and the bottom exit enclosure 36 are shown in the closed position due to gas pressure. The inner sphere wall 40 material seams 50 connecting the inner sphere wall panel segments 60 are shown converging toward the top and bottom of the present invention and around the center of it. The fabric handles 22 shown are used to separate the two exit enclosure panels 24,36 upon deflation of the invention.

Figure 5:
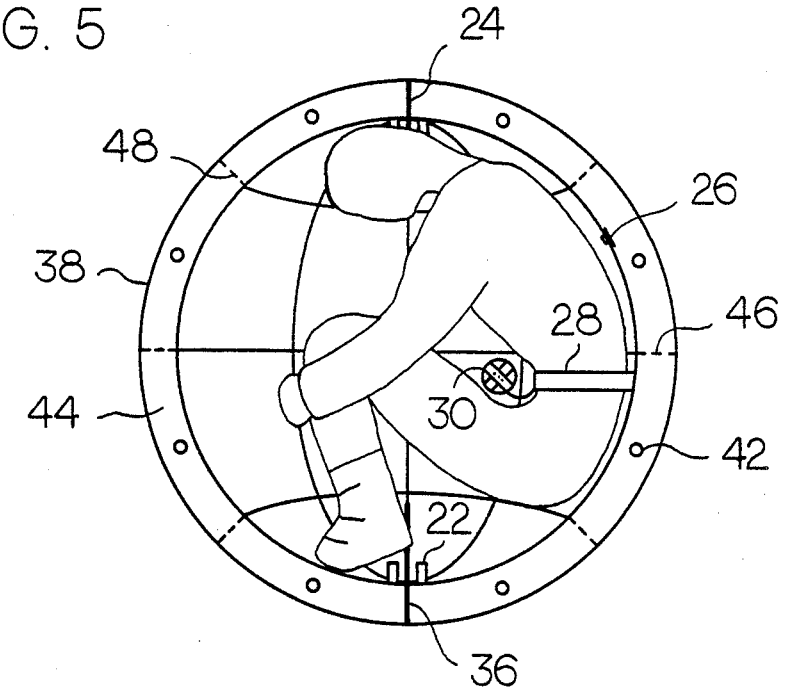
FIG. 5 is a section view along section line 4—4 of FIG. 2 showing a person crouched in the fetal position inside of the inflated present invention.

FIG. 5 is the same inflated section view as FIG. 4 with a person crouched inside the present invention in the position one would assume upon inflation. The detachably attached belt 28 and the pressure vessel and valve 30 are shown positioned about the person's waist and secured to the inner sphere wall 40 at the rear of the belt 28. The fabric handles 22 shown are used to separate the two exit enclosure panels 24,36 upon deflation of the invention.

Figure 6:
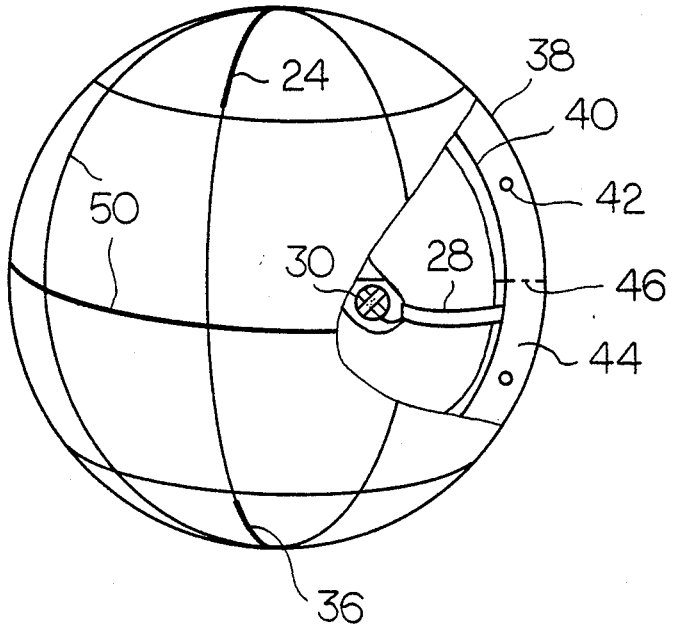
FIG. 6 is a perspective view of the inflated present invention with a cutaway area showing the person crouched in the fetal position inside of it.

FIG. 6 is a perspective view of the present invention with a cutaway area showing a person crouched inside and secured to the inner sphere wall 40 by means of the detachably attached belt 28 worn around the person's waist. The outer sphere wall 38 with the material seams 50 are shown as well as the top 24 and bottom 36 exit enclosures. The pressure vessel and valve 30 with the high pressure hose 32 are shown connected to the inner sphere wall 40 at the bulkhead fitting 34. Also shown are the longitudinal wall partition segments 44 and the large latitudinal 46 and small latitudinal wall partition segments 48 with the air communication openings 42 located in them.

Figure 7:
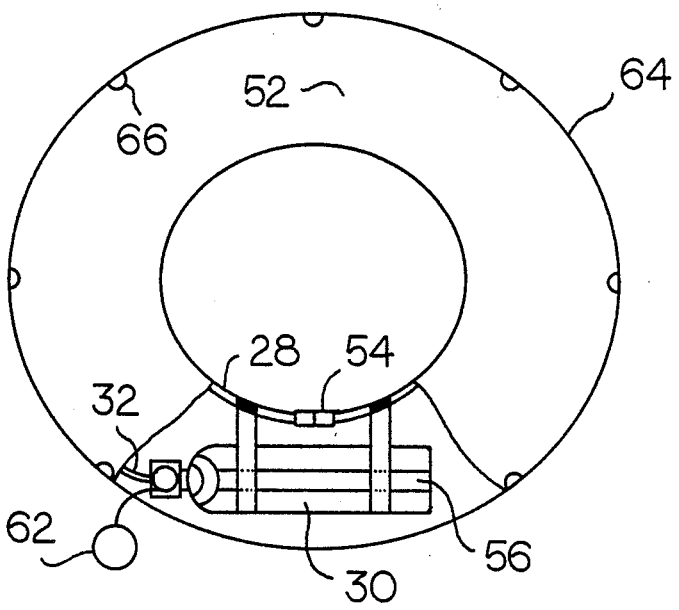
FIG. 7 shows a top view of the present invention in a deflated state and gathered into a belt pack with a cutaway showing pressure vessel location.

FIG. 7 is a top view of the belt pack 64 with the deflated wall material gathered into the belt pack detachable cover 52. A cutaway portion allows a view of pressure vessel and valve 30 location. The detachably attached belt 28 and belt buckle 54 and the pressure vessel and valve 30 are secured to the belt 28 by means of the bottle straps 56.

Figure 8:
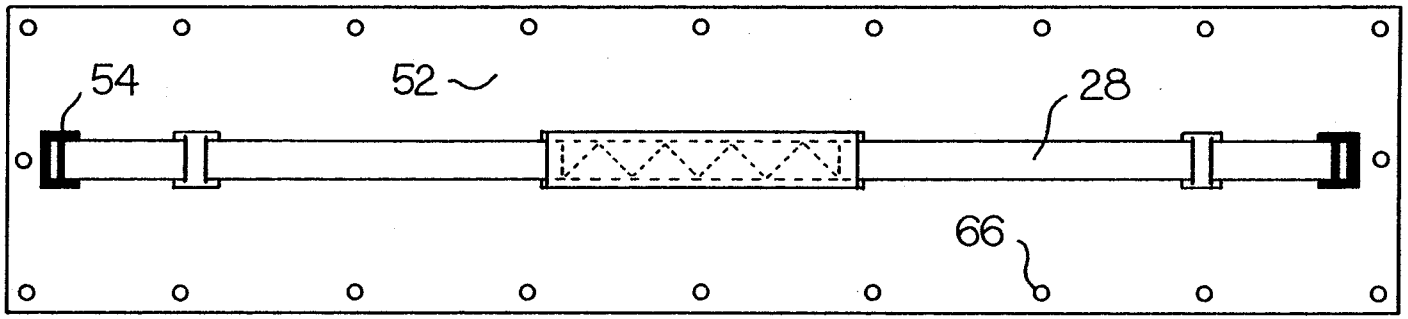
FIG. 8 is a plan view of the detachable cover for the belt pack.

FIG. 8 shows the detachable belt pack cover 52 with velcro hook and loop fasteners and showing the location of the belt 28 and its attachment as the cover would look like before the deflated material of the present invention is gathered into it.

Figure 9:
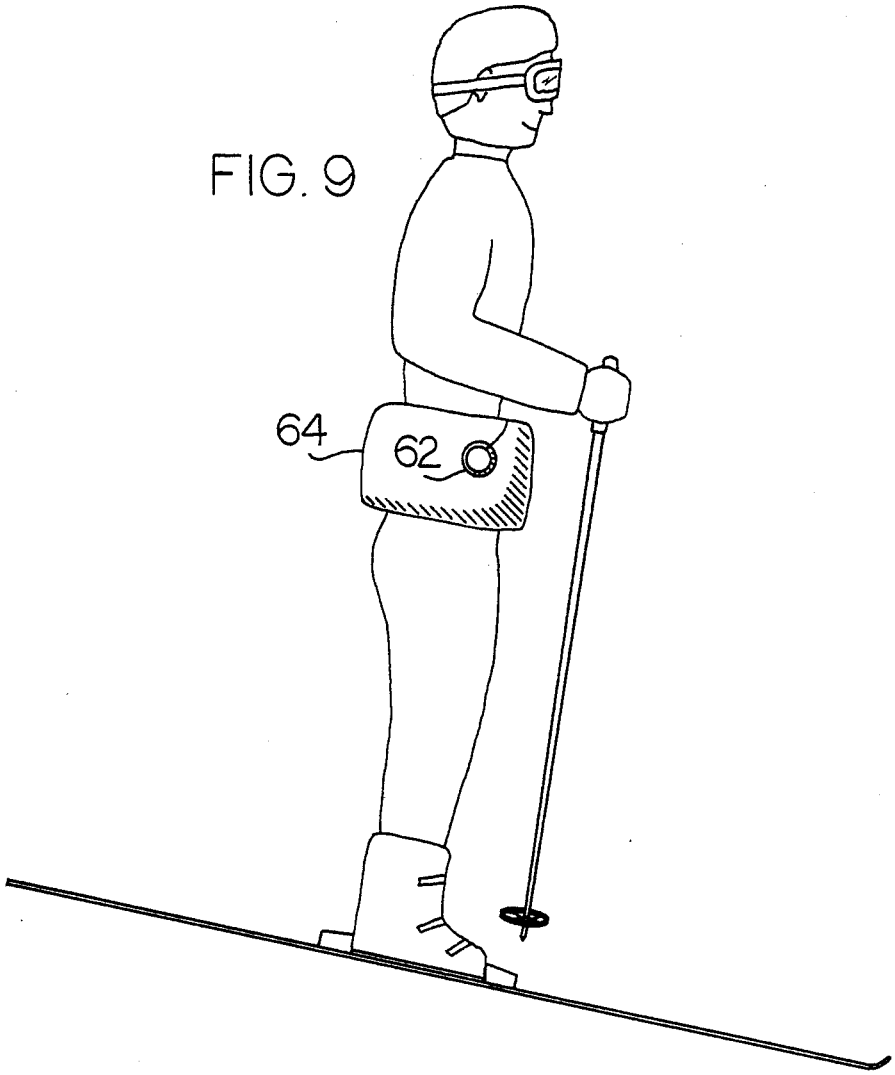
FIG. 9 shows a skier wearing the belt pack secured around the waist with the detachably attached belt.

FIG. 9 shows a skier wearing the present invention as it is stored deflated and gathered in a belt pack 64 around the waist and ready to be instantly used. The inflation pull ring 62 is placed in a protected but readily accessible location on the upper front of the belt pack 64.

Figure 10:
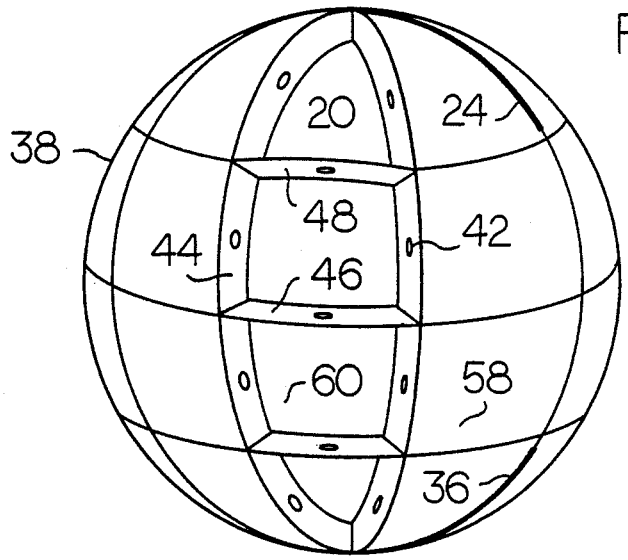
FIG. 10 shows the typical location of the longitudinal and the large and small latitudinal wall partition segments with the openings to allow for air communication between the chambers.

FIG. 10 is a perspective view of the present invention in the inflated state with a portion of the outer sphere wall panel segments 58 removed from the outer sphere wall 38. The view shows the placement of the longitudinal wall partition segments 44, the large latitudinal wall partition segment 46, the small latitudinal wall partition segments 48 and the where they are sealingly and flexibly joined to the inner sphere wall panel segments 60 and the outer sphere wall panel segments 58. Typically to all of the wall partition segments 44,46,48 are the air communication openings 42 to allow for free air flow throughout all the chambers in the space between the inner sphere wall 40 and the outer sphere wall 38.

Figure 11:
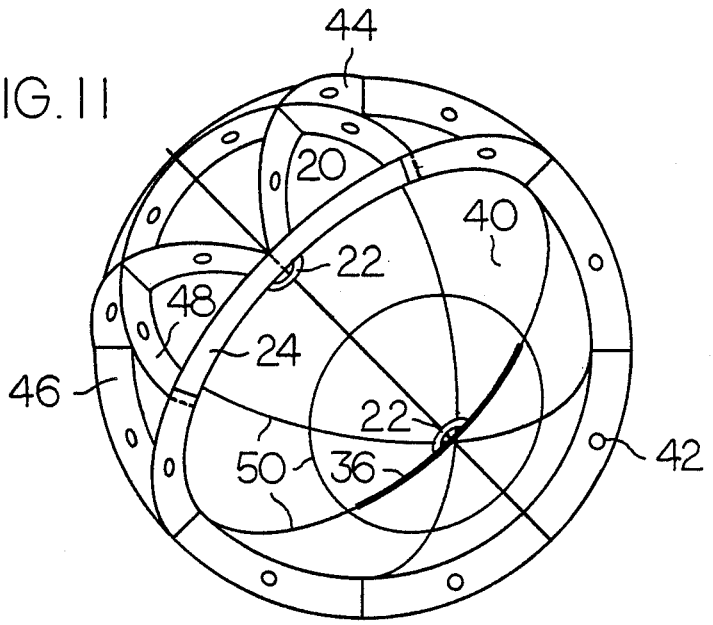
FIG. 11 is a view of the present invention inflated with a quarter portion removed and with the outer sphere wall panel material removed to show the assembly of the wall partition segments as they attach flexibly and sealingly to the inner sphere wall panel material and converge toward and join at the top exit enclosure.

FIG. 11 is a perspective view from above the inflated present invention with one quarter of the concentric spheres removed and looking down at the top exit enclosure 24 area. Only one side of the exit enclosure panel 24 is seen. The convergence of the longitudinal wall partition segments 44 is seen, as the outer sphere wall panel segments 58 that form the outer sphere wall 38 have been removed to show the large and small latitudinal wall partition segments 46,48, which form part of the chambers 20. The bottom exit enclosure 36 is seen with both of the exit panel sides pressed tightly together as they would be in the inflated state of the invention. The two exit enclosure panel sides are covered with the well known Dupont velcro hook and loop material to minimize shifting of the material. The fabric handles 22 shown are used to separate the two exit enclosure panels 24,36, one handle on each side of the exit enclosure, upon deflation of the invention.

Figure 12:
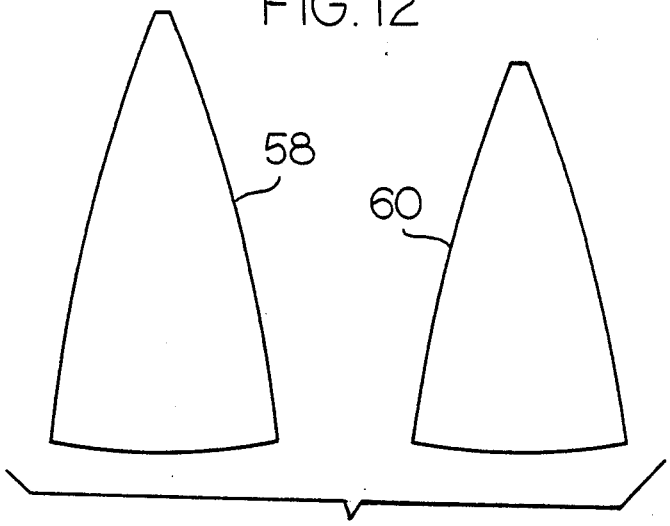
FIG. 12 shows the typical spherical triangle shape of wall panel segments for the outer sphere wall and the inner sphere wall.
Figure 12:
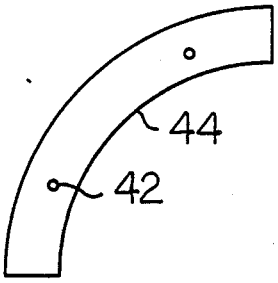
Figure 12:
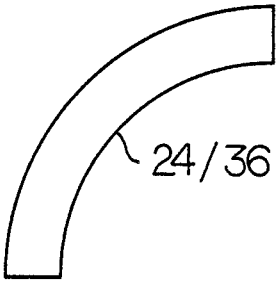
Figure 12:
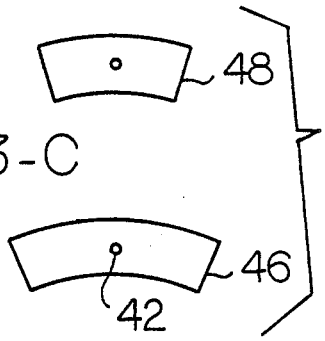
Figure 12:
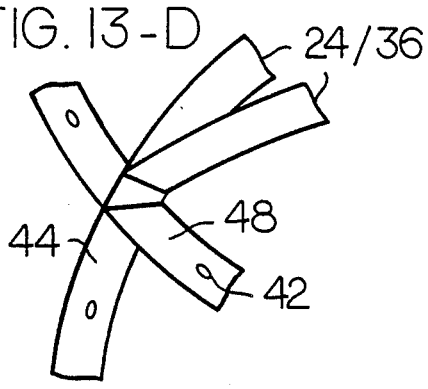

FIG. 12 shows the typical spherical triangle shape of the outer sphere wall panel segments 58 and the inner sphere wall panel segments 60.

FIGS. 13 A–D show the typical shape of the wall partition segments 44,46,48. The longitudinal wall partition segments 44 have two air communication openings in each partition, one on each side of the attachment location of the small latitudinal wall partition segment 48. The large latitudinal wall partition segment 46 and the small latitudinal wall partition segment 48 have only one air communication opening 42 in the material. The wall partition segments 44,46,48 serve to limit the spacing between the inner sphere wall 40 and the outer sphere wall 38 and tend to keep such walls more or less uniformly spaced when the present invention is inflated.

Operation of Invention - Preferred Embodiment

The avalanche personnel or other skiers using the present invention should ready it for use by stepping into the center of the belt pack 64 and pulling it up into position around the waist and adjusting the detachably attached belt 28 and belt buckle 54 to a snug fit. The present invention is now ready for immediate use.

If an avalanche should occur while the person is skiing down a mountain, the person should release his ski bindings and pull the inflation pull ring 62 located on the front of the belt pack 64 and quickly bend over in a crouching position. The valve 30 is of the quick-opening manual pull type that requires only one-quarter of one turn to fully open it.

The gas pressure stored in the pressure vessel 30 is released through the valve and flexible hose 32 and through the bulkhead fitting 34 that is secured sealingly in the inner sphere wall 40. The air pressure flows into the chambers 20 between the outer sphere wall 38 and the inner sphere wall 40 through the air communications openings 42 and very quickly inflates the present invention. The fixedly attached detachable cover 52 of the belt pack 64 is removed by the expanding material of the sphere walls 38,40. The inflatable and airtight said space between the inner sphere wall 40 and the outer sphere wall 38 can be inflated with a gas substantially in excess of ambient air pressure, partitioning means in said space limiting the separation of the outer 38 and inner sphere walls 40, whereby the present invention is expanded forcefully to its generally spherical configuration and strongly tends to retain and regain such configuration against any deforming forces. This provides protective cushioning and buoyancy for the person, as the belt 28 holds the body against the inner sphere wall 40. The person is totally enclosed inside the present invention and the sliding snow is unable to surround the extremities of the body and drag a skier underneath the surface of the snow. The size and shape of the pressurized sphere enable it to remain buoyant throughout the avalanche and at the conclusion of the slide the person can release the air pressure through the over-pressure relief valve 26 located on the inner sphere wall 40. The person can then release the belt 28 at the buckle 54 and spread apart the exit enclosure 24 or 36 using the fabric handles 22 and step out of the present invention.

While the above description contains many specificities, the reader should not construe these as limitations on the scope of the invention, but merely as exemplifications of preferred embodiments thereof. Those skilled in the art will envision many other possible variations are within its scope. Skilled persons, for example, will readily be able to change the dimensions and shapes of the various embodiments and the alternative materials used in its manufacture. The present invention can also be readily adapted to use in marine or other enviroments by adding other items. Since the body is totally enclosed within the sphere, the danger of hypothermia caused by immersion in cold water is greatly reduced or eliminated. Accordingly the reader is requested to determine the scope of the invention by the appended claims and their legal equivalents, and not by the examples which have been given.

I claim:

1. In survival equipment, a protective and buoyant device which is worn around the waist in a belt pack, in its uninflated condition, the belt pack having a detachably attached belt means and a cover means to hold ready the device prior to deployment, and which comprises a plurality of concentric spheres having a plurality of exit enclosure means, said concentric spheres including inner and outer sphere walls of flexibly impervious materials defining an inflatable and airtight space therebetween, partitioning means in said space limiting the separation of the inner sphere and outer sphere walls, said concentric spheres being so constructed and arranged to totally enclose and isolate an occupant upon inflation of the device from any environment outside the device, said belt means being fixedly attached to the inner sphere wall and also being removably connected to the user for securing his position relative to the spheres upon any acceleration or deceleration of the device, and pressure means operatively connected to said spheres for introducing a gas into said space under a pressure substantially in excess of ambient pressure whereby said spheres are forcefully expanded to a generally spherical configuration, said pressure also tending to maintain the generally spherical configuration against any deforming forces, whereby the user of the device is cushioned and protected while remaining buoyant.

2. The invention of claim 1, wherein the exit enclosure means comprises opposing flat curved panels, two per exit enclosure, of flexibly impervious material that are curved arcs of the same radii as the concentric spheres and equal in size and joined sealingly and flexibly to the partitioning means at forks formed on each end of the panels just above a junction of the partitioning means and to the outer and inner walls of the concentric spheres, said panels closing tightly and sealingly against each other under the force of gas pressure from within the chambers and are held from shifting with hook and pile fastener material to allow the device to totally enclose and seal a person inside the device.

3. The invention of claim 1, wherein the belt means comprises an adjustable, flexible belt having locking means to secure said belt around a user, being fixedly attached to the inner sphere wall and being removedly attached to the user.

4. The invention of claim 1, wherein the cover means comprises a rectangle of suitable flexible material, said cover means having a longer side and a shorter side, also having mating hook and pile fastener means spaced at intervals around the perimeter of said cover means, said cover means material being fixedly attached to the belt at one point, said belt being disposed parallel to the longer side of said cover means.

* * * * *